US008979223B2

(12) United States Patent
Huang

(10) Patent No.: US 8,979,223 B2
(45) Date of Patent: Mar. 17, 2015

(54) ADJUSTABLE COUPLING DEVICE FOR CONNECTION BETWEEN SLIDING RAIL ASSEMBLY AND A SLIDING BOX

(71) Applicant: Nan Juen International Co., Ltd., Yingge Dist., New Taipei (TW)

(72) Inventor: Kuo-Sheng Huang, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 0 days.

(21) Appl. No.: 13/712,568

(22) Filed: Dec. 12, 2012

(65) Prior Publication Data

US 2014/0314347 A1 Oct. 23, 2014

(51) Int. Cl.
*A47B 88/00* (2006.01)
*A47B 88/04* (2006.01)

(52) U.S. Cl.
CPC ..... *A47B 88/0422* (2013.01); *A47B 88/0407* (2013.01)
USPC ..... 312/334.4; 312/334.5

(58) Field of Classification Search
USPC ..... 312/334.4, 334.5, 334.6, 330.1, 334.27, 312/334.32, 351; 384/22
See application file for complete search history.

(56) References Cited

U.S. PATENT DOCUMENTS

| | | | | |
|---|---|---|---|---|
| 5,439,283 | A * | 8/1995 | Schroder et al. | 312/334.4 |
| 5,588,729 | A * | 12/1996 | Berger | 312/334.4 |
| 5,664,855 | A * | 9/1997 | Lautenschlager et al. | 312/334.4 |
| 7,695,080 | B2 * | 4/2010 | Chen et al. | 312/333 |
| 8,585,165 | B2 * | 11/2013 | Liang et al. | 312/334.4 |
| 8,696,078 | B2 * | 4/2014 | Gasser | 312/348.2 |
| 8,727,460 | B2 * | 5/2014 | Grabher | 312/333 |
| 8,764,136 | B2 * | 7/2014 | Grabherr | 312/334.4 |
| 8,854,769 | B1 * | 10/2014 | Liang et al. | 360/125.51 |
| 8,857,929 | B2 * | 10/2014 | Netzer | 312/334.5 |
| 2002/0158557 | A1 * | 10/2002 | Weichelt | 312/334.4 |
| 2003/0234603 | A1 * | 12/2003 | Salice | 312/334.5 |
| 2004/0239219 | A1 * | 12/2004 | Kim et al. | 312/334.4 |
| 2009/0236959 | A1 * | 9/2009 | Liang et al. | 312/334.4 |
| 2009/0251037 | A1 * | 10/2009 | Berger | 312/334.1 |
| 2011/0068670 | A1 * | 3/2011 | Ritter | 312/334.1 |
| 2011/0129172 | A1 * | 6/2011 | Liang et al. | 384/22 |
| 2012/0292465 | A1 * | 11/2012 | Holzer et al. | 248/201 |

FOREIGN PATENT DOCUMENTS

DE 4301327 A1 * 8/1993 ..... A47B 88/12

* cited by examiner

*Primary Examiner* — Hanh V Tran

(57) ABSTRACT

An adjustable coupling device includes a base member fastened to a sliding rail assembly, a sliding block connected to the base member to support a sliding box, a first adjustment member rotatable to adjust the position of the sliding box horizontally subject to the constraint of a limiter member, and a second adjustment member rotatable to adjust the position of the sliding box vertically subject to the constraint of a push member.

7 Claims, 11 Drawing Sheets

ADJUSTABLE COUPLING DEVICE FOR CONNECTION BETWEEN SLIDING RAIL ASSEMBLY AND A SLIDING BOX

BACKGROUND OF THE INVENTION

1. Field of the Invention

The present invention relates to sliding rail assembly mounting technology and more particularly, to an adjustable coupling device for coupling between a sliding rail assembly and a sliding box sliding rail assembly that allows adjustment of the position of the sliding box horizontally as well as vertically relative to the sliding rail assembly.

2. Description of the Related Art

Sliding rail assemblies are intensively used with sliding boxes in storage cabinets for storing things. Conventionally, horizontal and vertical mounting holes are located at sliding rail assemblies, and fastening members are selectively mounted in the horizontal and vertical mounting holes to affix a sliding box to a pair of sliding rail assemblies. When going to adjust the position of a sliding box relative to the respective sliding rail assemblies, the user must unfasten the fastening members from the respective horizontal and vertical mounting holes of the sliding rail assemblies and then fasten the fastening members to other selected horizontal and vertical mounting holes of the sliding rail assemblies. This sliding box position adjustment procedure is complicated.

SUMMARY OF THE INVENTION

The present invention has been accomplished under the circumstances in view. It is the main object of the present invention to provide an adjustable coupling device, which is practical for use to couple a sliding box to a sliding rail assembly, allowing adjustment of the position of the sliding box relative to the sliding rail.

It is another object of the present invention to provide an adjustable coupling device for connection between a sliding box and a sliding rail assembly, which allows adjustment of the position of the sliding box relative to the sliding rail horizontally as well as vertically in a stepless manner.

To achieve these and other objects of the present invention, an adjustable coupling device is designed for coupling between a sliding rail assembly and a sliding box. The adjustable coupling device comprises a base member comprising a base portion, an accommodation chamber defined in the base portion, a post extended from the base portion and a sliding rail disposed at one side of the base portion. A sliding block comprising a block body, a sliding way located at a bottom side of the block body and slidably coupled to the sliding rail of the base member and a coupling shank extended from the block body, a first adjustment member comprising a coupling hole pivotally coupled to the coupling shank of the sliding block and a scroll groove located at a bottom side thereof, and a limiter member affixed to the base portion of the base member and comprising a guide rib coupled to the scroll groove of the first adjustment member for guiding the first adjustment member toward or away from the limiter member to carry the sliding block forward or backward along the sliding rail during rotation of the first adjustment member relative to the coupling shank by an external force, a push member mounted in the accommodation chamber of the base member and comprising a plurality of push plates disposed at one lateral side thereof and a bevel face located at a front side thereof, and a second adjustment member pivotally coupled to the post of the base member and comprising a thrust groove spirally extending around the periphery thereof and coupled with the push plates of the push member.

DETAILED DESCRIPTION OF THE PREFERRED EMBODIMENT

Figure 1:
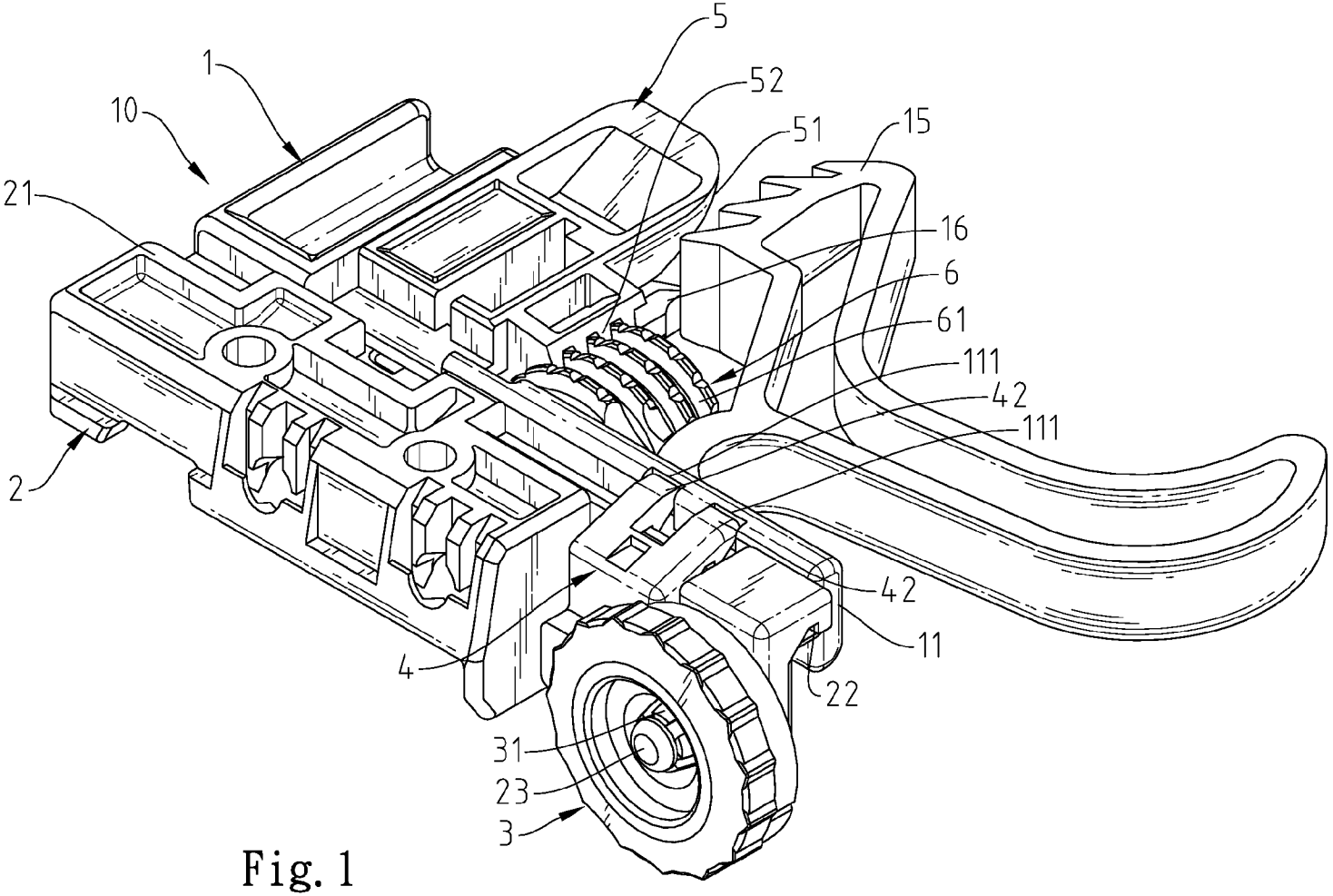
FIG. 1 is an elevational view of an adjustable coupling device in accordance with the present invention.
Figure 2:
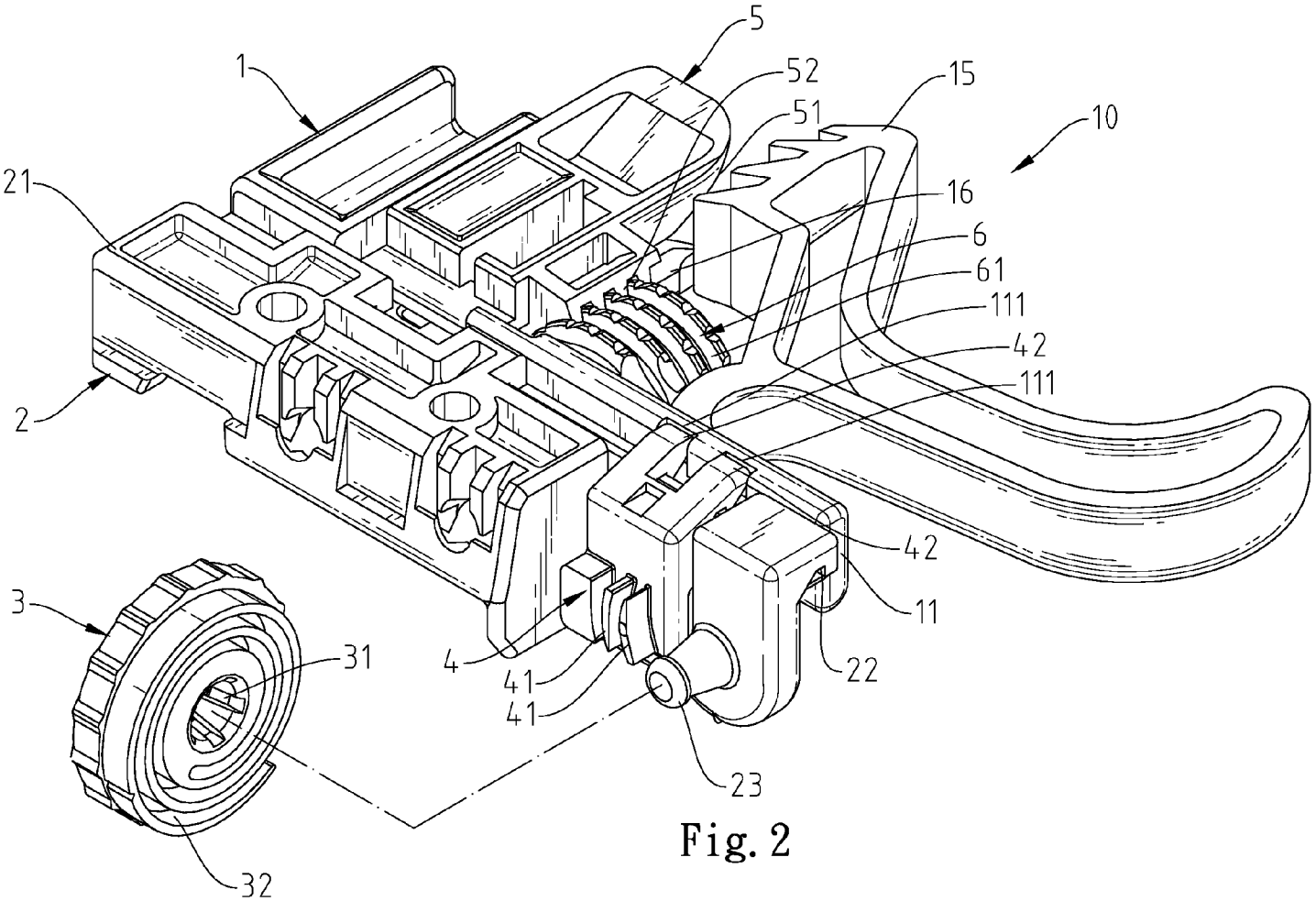
FIG. 2 is an exploded view of the adjustable coupling device in accordance with the present invention (I).
Figure 3:
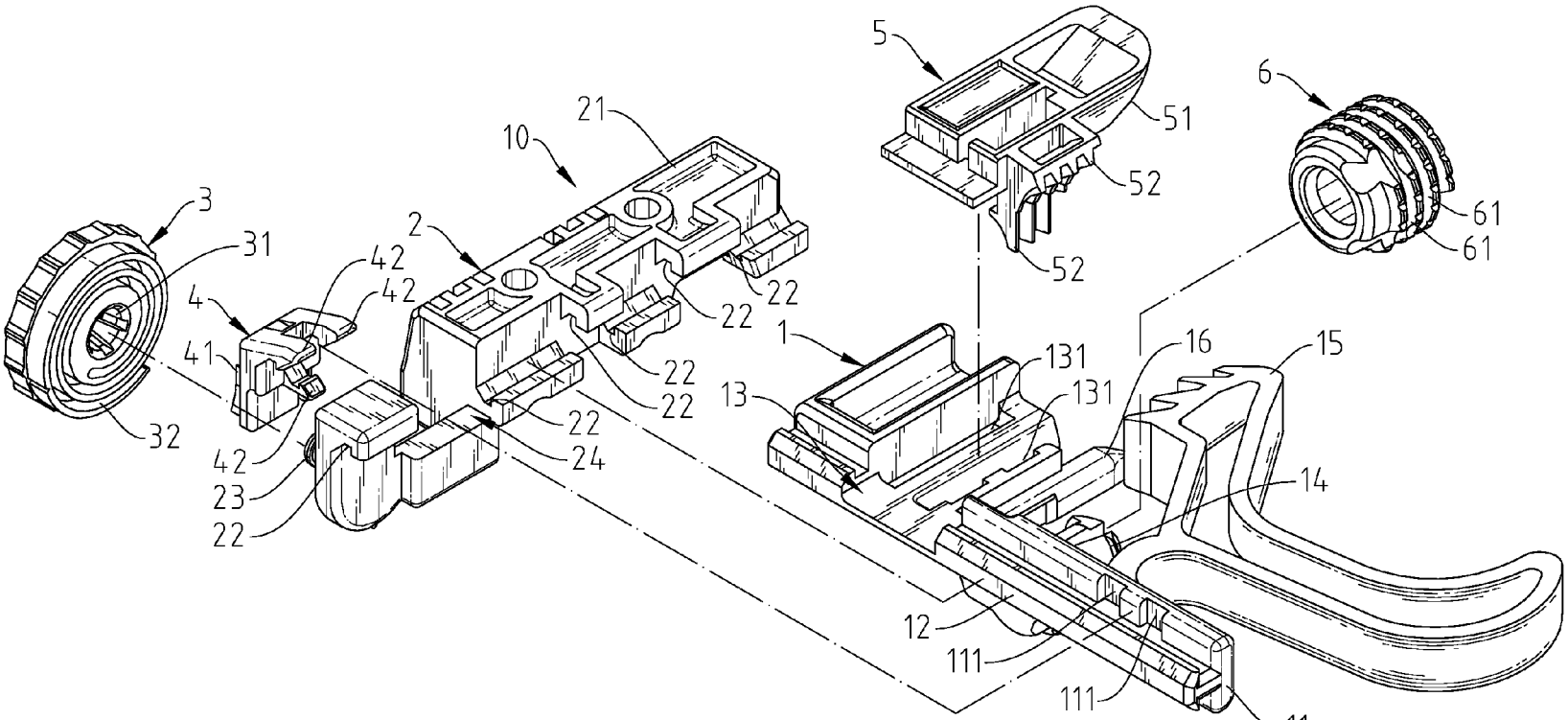
FIG. 3 is an exploded view of the adjustable coupling device in accordance with the present invention (II).
Figure 4:
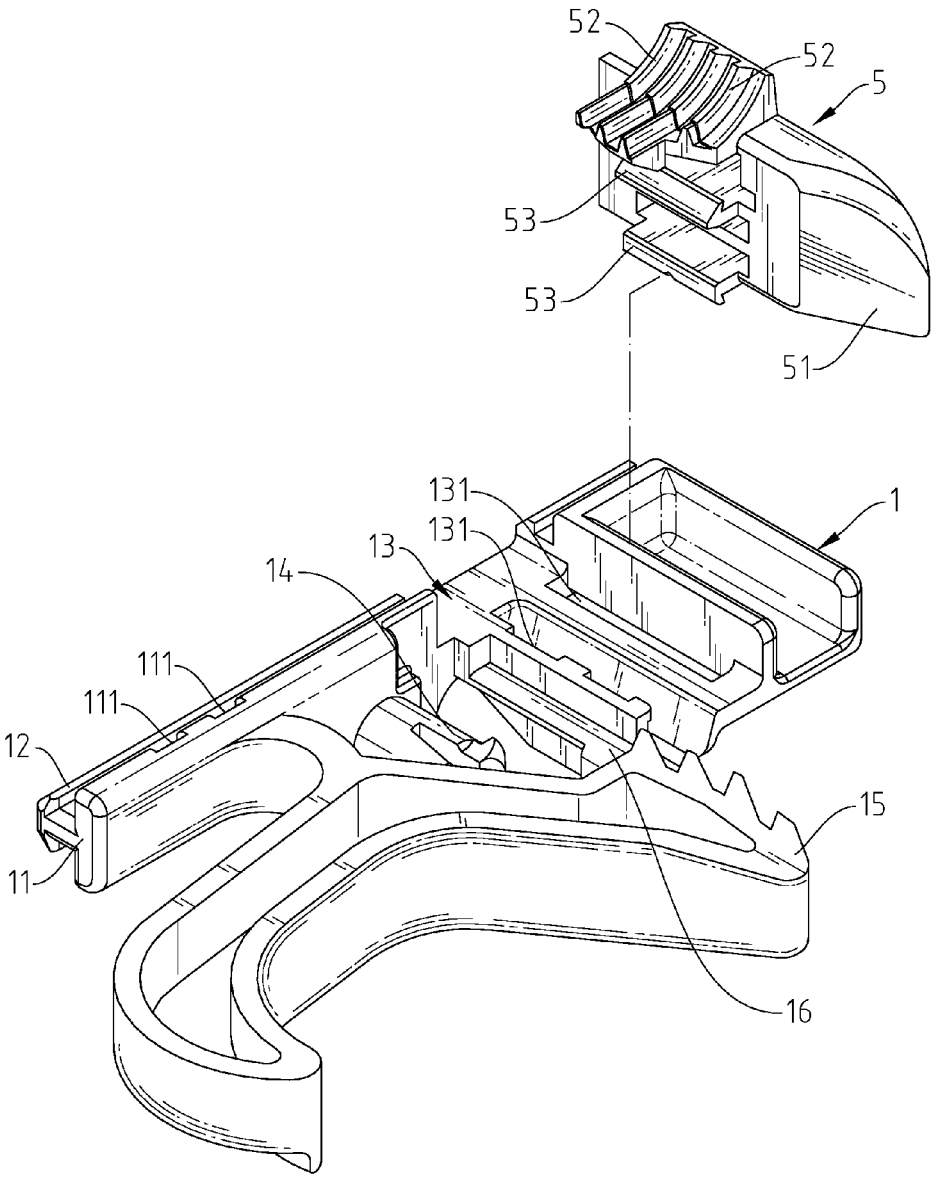
FIG. 4 is an exploded view of the adjustable coupling device in accordance with the present invention (III).

Referring to FIGS. 1-3, an adjustable coupling device 10 in accordance with the present invention is shown comprising a base member 1, a sliding block 2, a first adjustment member 3, a limiter member 4, a push member 5 and a second adjustment member 6.

The base member 1 comprises a base portion 11, a sliding rail 12 disposed at one side of the base portion 11, a plurality of locating grooves 111 located at the base portion 11 and facing toward the sliding rail 12, an accommodation chamber 13 defines in the base portion 11, a post 14 disposed at one lateral side relative to the accommodation chamber 13, an elongated groove 131 disposed in the accommodation chamber 13, a serrated engagement portion 15 extended from the base portion 11 opposite to the sliding rail 12, and a bearing portion 16 located at the base portion 11 at one side relative to the serrated engagement portion 15.

The sliding block 2 comprises a block body 21, a limiter space 24 defined in the block body 21, a sliding way 22 located at a bottom wall of the block body 21 and coupled to the sliding rail 12 of the base member 1 for enabling the sliding block 2 to be moved back and forth along the sliding rail 12, and a coupling shank 23 extended from the block body 21 at one side of the limiter space 24.

The first adjustment member 3 comprises a coupling hole 31 coupled to the coupling shank 23 of the base member 2, and a scroll groove 32 located at a bottom side thereof.

The limiter member 4 is mounted in the limiter space 24, comprising a plurality of retaining portions 42 clamped on the sliding rail 12 of the base member 1 and positioned in the locating grooves 111 to fixedly secure the limiter member 4 to the base portion 11 of the base member 1, and a guide rib 41 coupled to the scroll groove 32 of the first adjustment member 3.

The push member 5 is mounted in the accommodation chamber 13, comprising a bevel face 51 located at one end thereof, a plurality of push plates 52 disposed at one lateral side thereof in a parallel manner, and a hook 53 extended from a bottom side thereof and coupled to the elongated groove 131 for enabling the push member 5 to be moved back and forth in the accommodation chamber 13.

The second adjustment member 6 is pivotally coupled to the post 14 of the base member 1, comprising a thrust groove 61 extending around the periphery and coupled with the push plates 52 of the push member 5.

Figure 5:
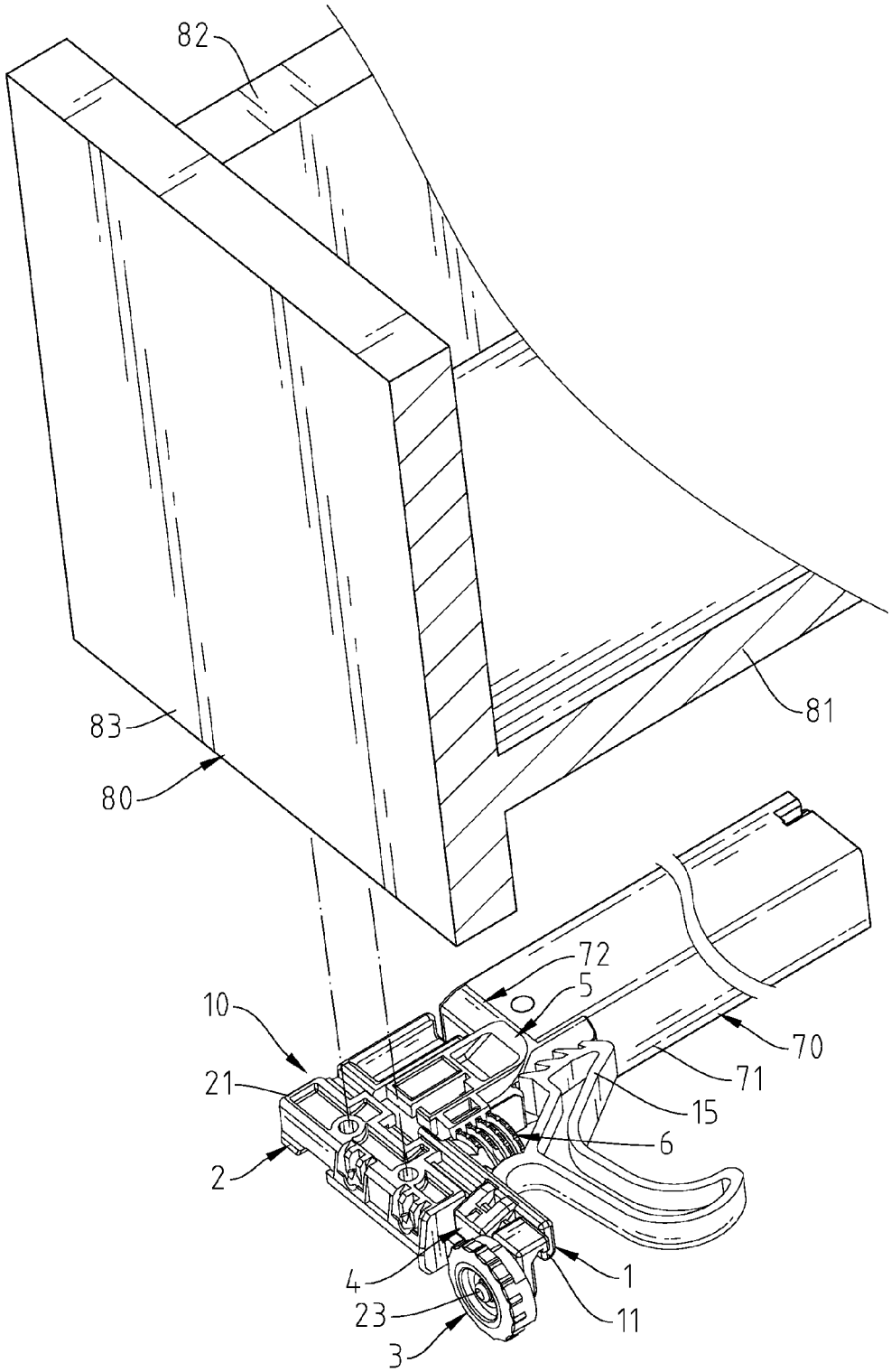
FIG. 5 is a schematic installed view of the present invention, illustrating the base member of the adjustable coupling device fastened to a sliding rail assembly before installation of a sliding box.
Figure 6:
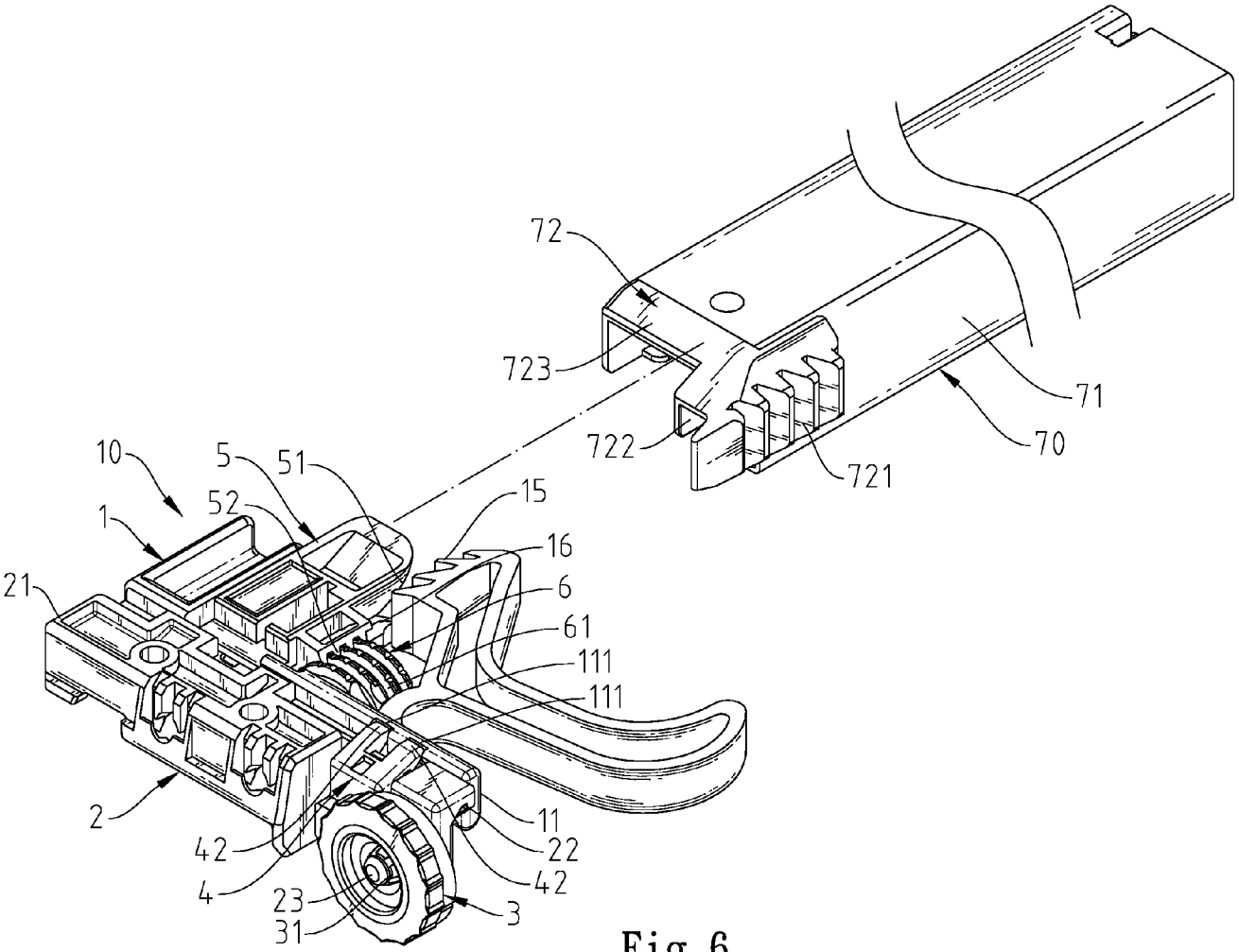
FIG. 6 illustrates the relationship between the adjustable coupling device and the top rail of a sliding rail assembly in accordance with the present invention.
Figure 7:
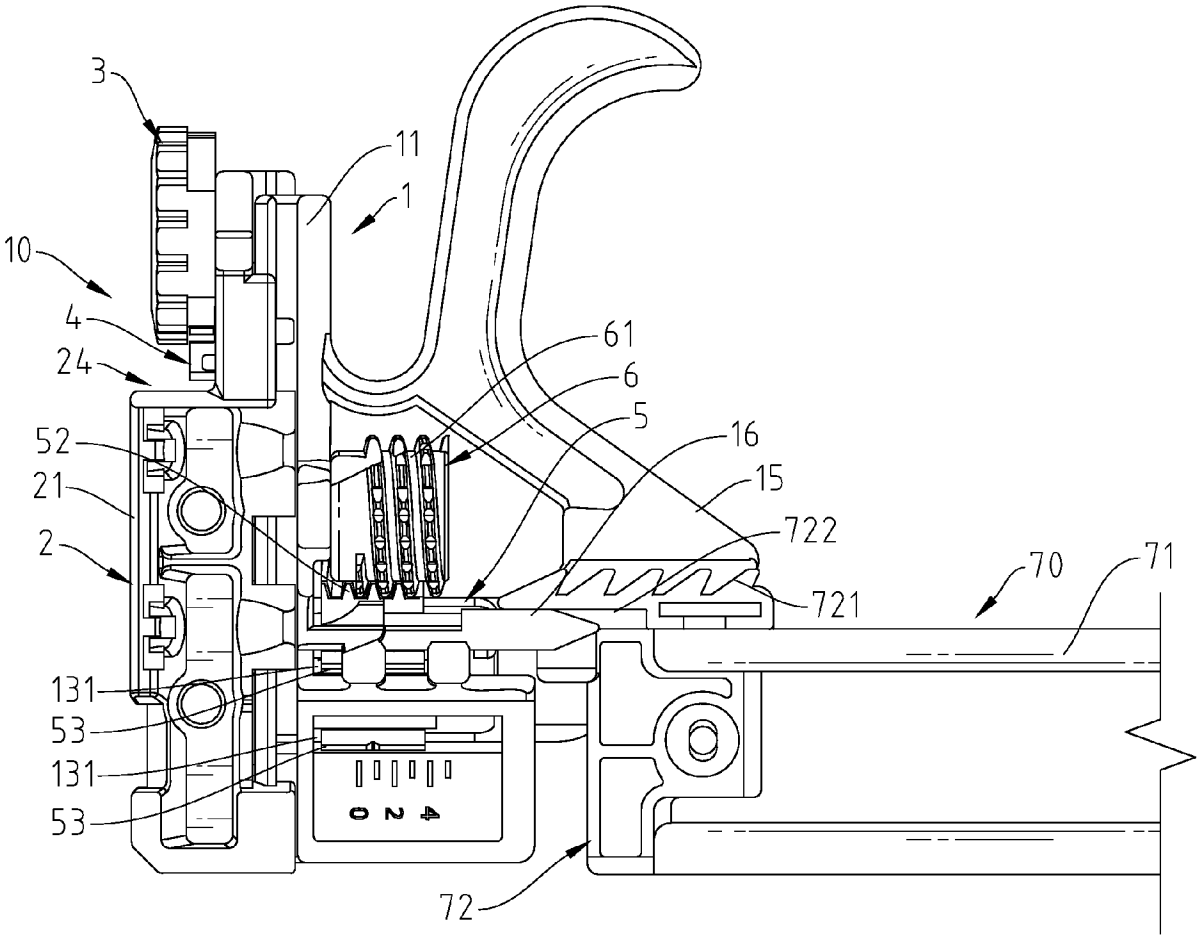
FIG. 7 is a bottom view of the present invention, illustrating the adjustable coupling device affixed to a sliding rail assembly.

Referring to FIGS. 5-7, the adjustable coupling device 10 is coupled between a sliding rail assembly 70 and a sliding box 80. The sliding box 80 comprises a bottom panel 81, a side panel 83 at each of two opposite lateral sides of the bottom panel 81, and a face panel 83 connected with the side panels 83 and the bottom panel 81 at a front side. The sliding rail assembly 70 comprises a top rail 71 slidably supported on a bottom rail (not shown). The bottom panel 81 of the sliding box 80 is supported on the top rail 71. The top rail 71 comprises a connection end piece 72 at a front end thereof. The connection end piece 72 comprises a serrated engagement portion 721 located at one lateral side thereof and engaged with the serrated engagement portion 15 of the base member 1, a receiving chamber 722 defined in a bottom side thereof that receives the bearing portion 16 of the base member 1, and a bevel face 723 at a distal end thereof.

Figure 8:
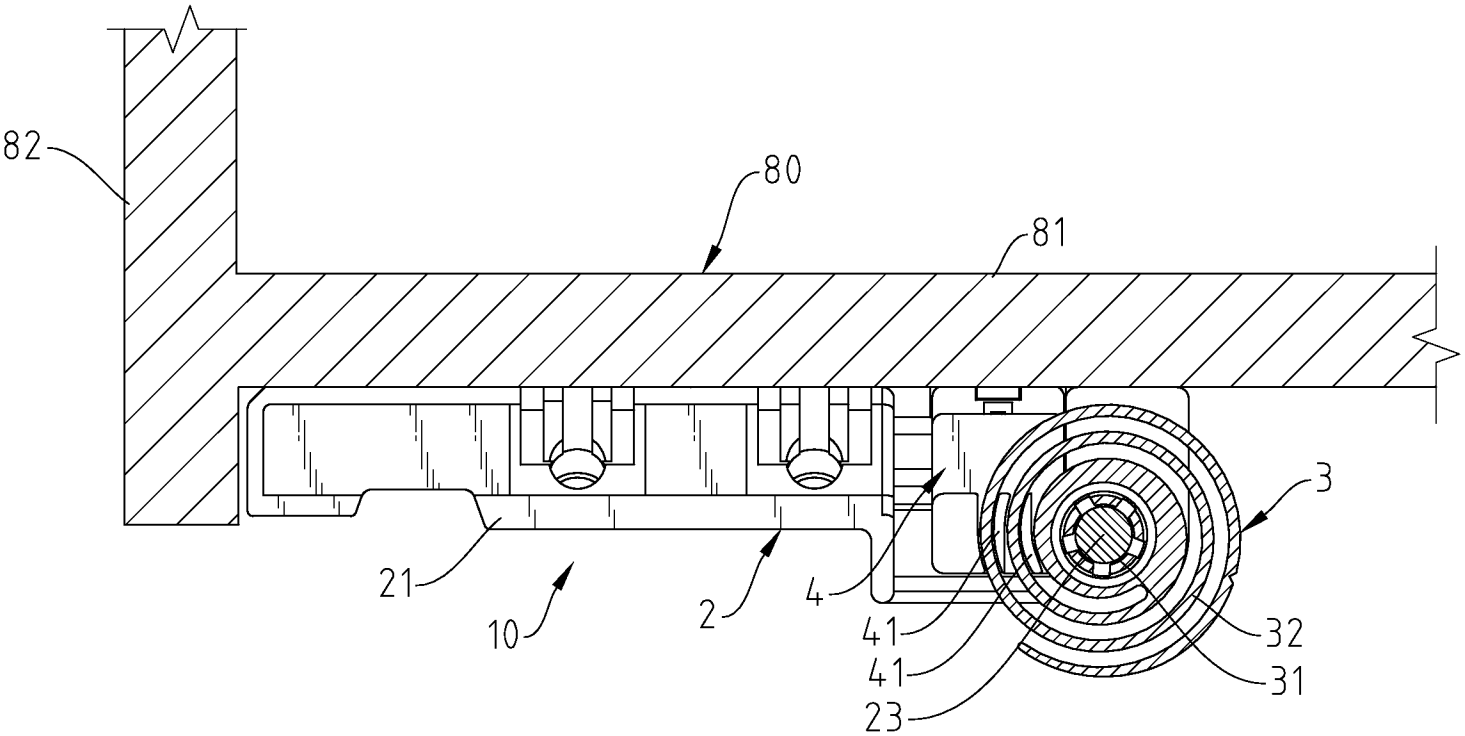
FIG. 8 is a schematic applied view of the present invention, illustrating the position of the sliding box adjusted horizontally (I).
Figure 9:
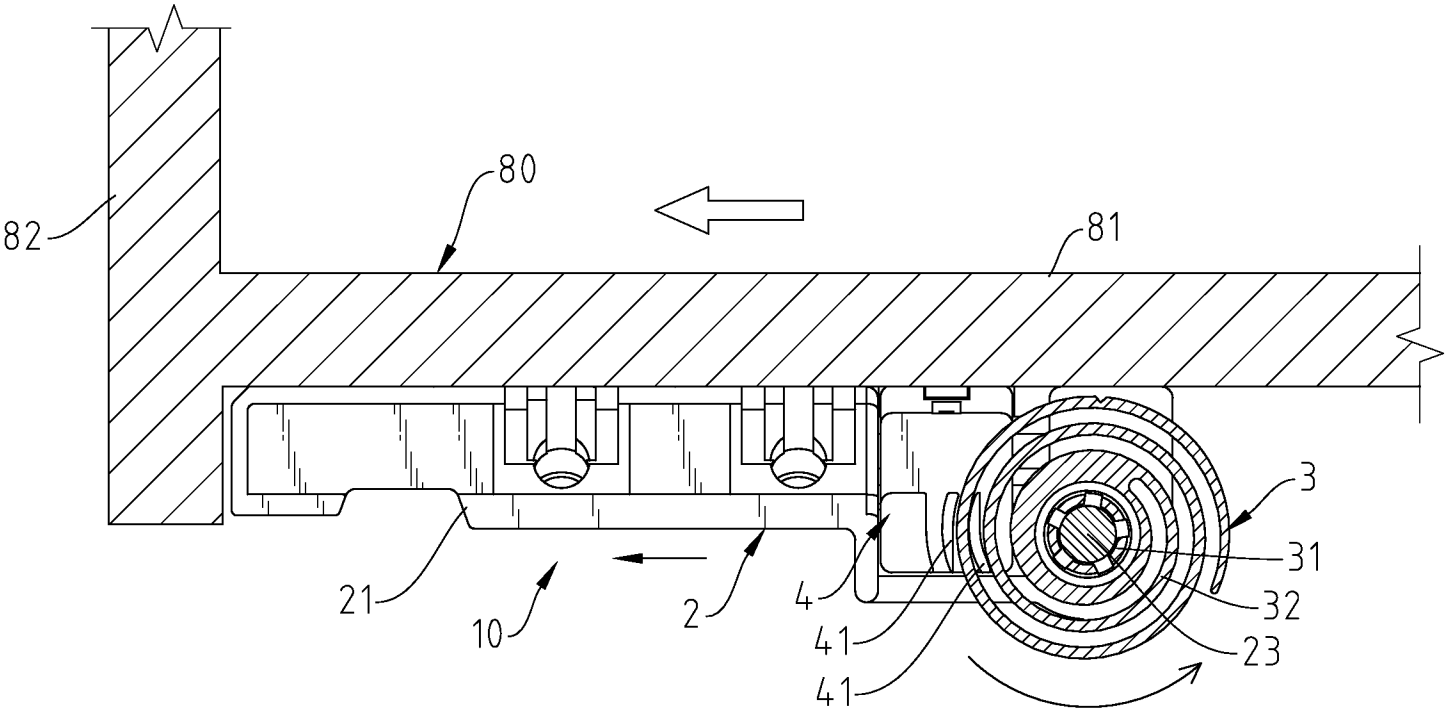
FIG. 9 is a schematic applied view of the present invention, illustrating the position of the sliding box adjusted horizontally (II).

Referring to FIGS. 8 and 9 and FIGS. 1 and 3 again, when going to adjust the position of the sliding box 80 horizontally, the user can rotate the first adjustment member 3 of the adjustable coupling device 10. Because the guide rid 41 of the limiter member 4 is coupled to the scroll groove 32 of the first adjustment member 3, the first adjustment member 3 will move toward or away from the limiter member 4 to carry the sliding block 2 forward or backward along the sliding rail 12 of the base member 1 to the desired position when it is rotated by the user, thereby adjusting the position of the sliding box 80 horizontally in a stepless manner.

Figure 10:
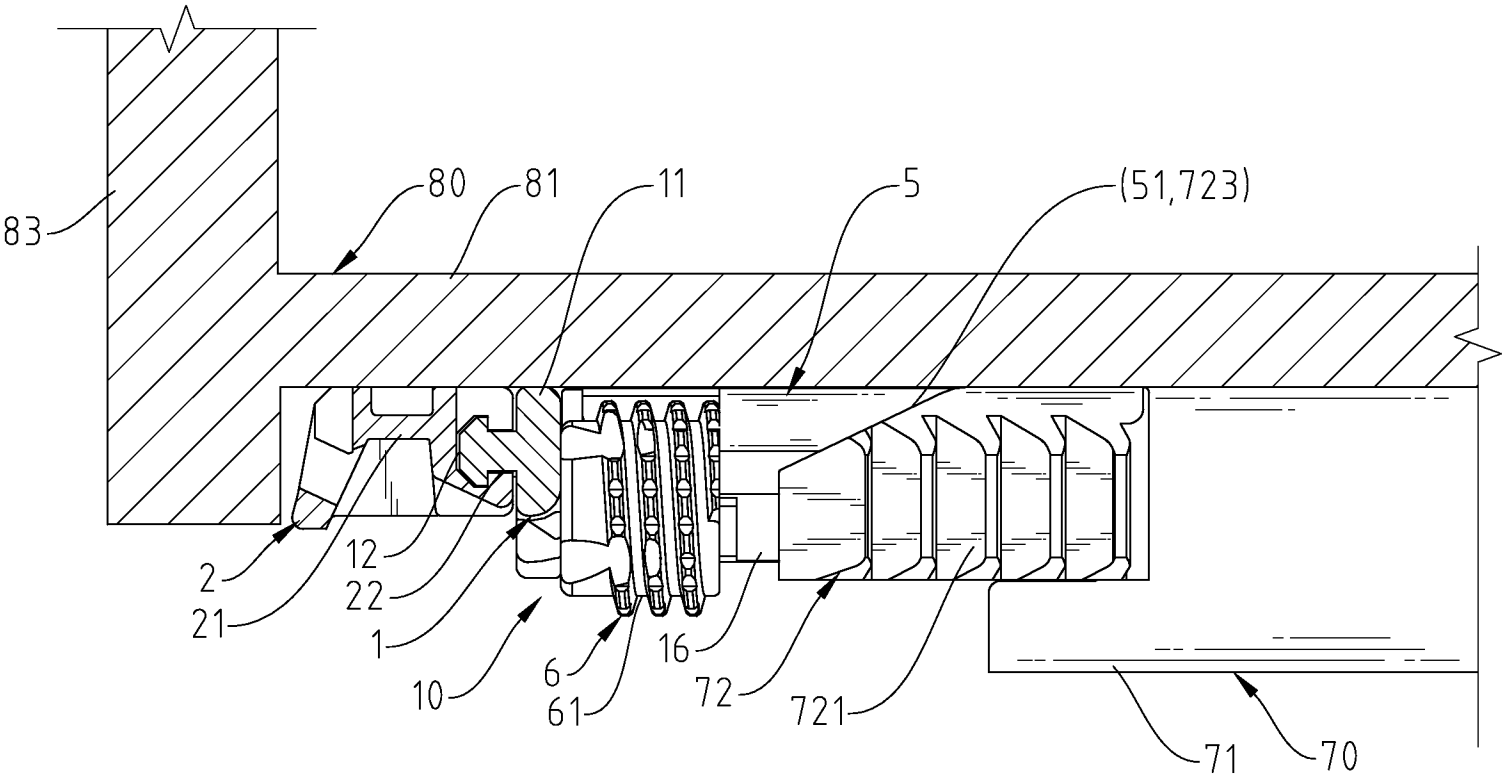
FIG. 10 is a schematic applied view of the present invention, illustrating the position of the sliding box adjusted vertically (I).
Figure 11:
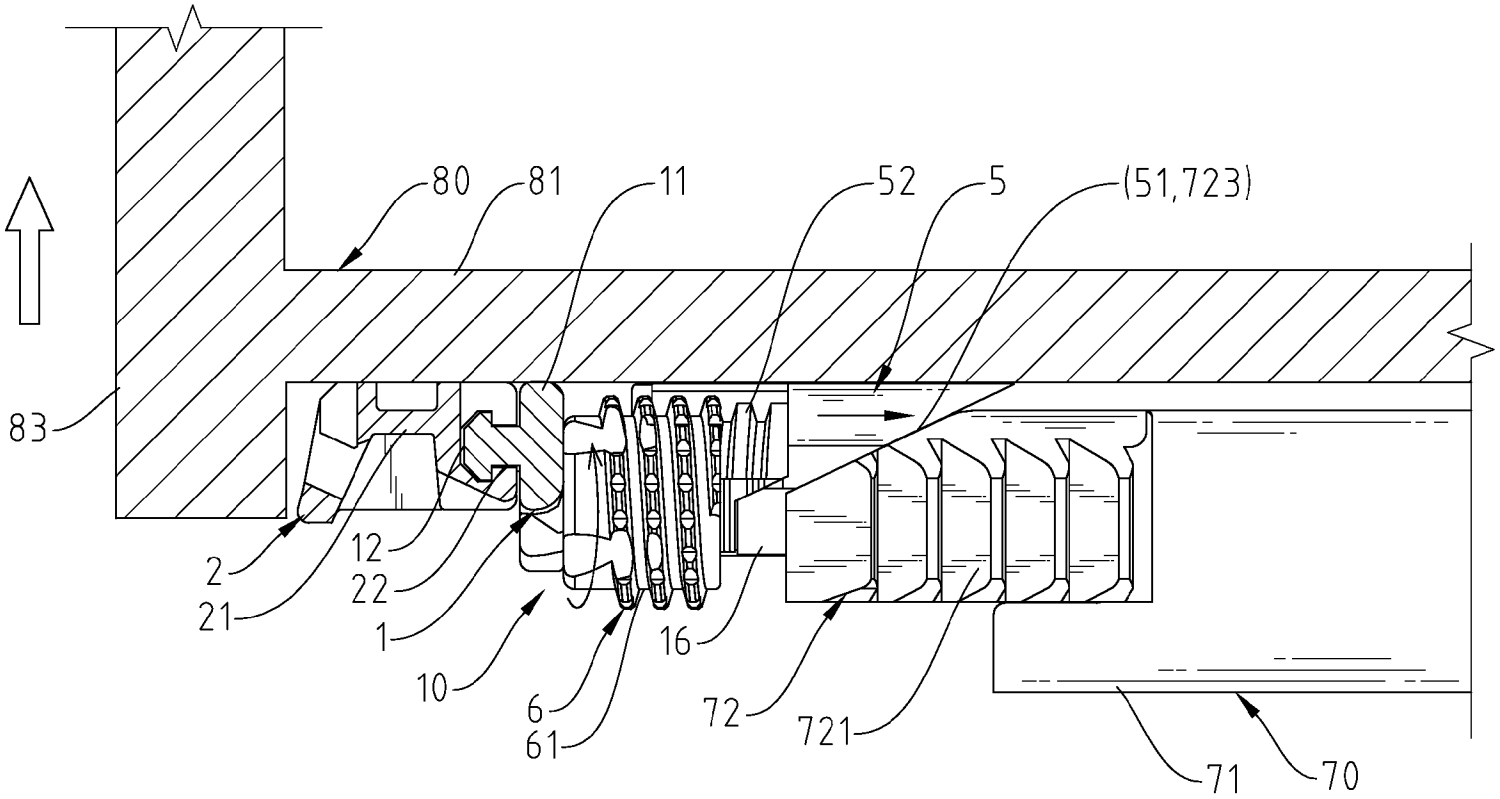
FIG. 11 is a schematic applied view of the present invention, illustrating the position of the sliding box adjusted vertically (II).

Referring to FIGS. 10 and 11 and FIGS. 1 and 7 again, when going to adjust the position of the sliding box 80 vertically, the user can rotate the second adjustment member 6 of the adjustable coupling device 10. Because the push plates 52 of the push member 5 is coupled to the spirally extended thrust groove 61 of the second adjustment member 6, the push plates 52 will be moved toward or away from the connection end piece 72 of the sliding rail assembly 70. Further, when the push member 5 is moved toward the connection end piece 72, the bevel face 51 of the push member 5 will be abutted against the bevel face 723 of the connection end piece 72, causing the push member 5 to be lifted or lowered, and therefore the elevation of the bottom panel 81 of the sliding box 80 is relatively adjusted.

What the invention claimed is:

1. An adjustable coupling device for coupling between a sliding rail assembly and a sliding box, comprising:

a base member comprising a base portion, an accommodation chamber defined in said base portion, a post extended from said base portion, and a sliding rail disposed at one side of said base portion;

a sliding block comprising a block body, a sliding way located at a bottom side of said block body and slidably coupled to said sliding rail of said base member, and a coupling shank extended from said block body;

a first adjustment member comprising a coupling hole pivotally coupled to said coupling shank of said sliding block, and a scroll groove located at a bottom side thereof; and a limiter member affixed to said base portion of said base member, said limiter member comprising a guide rib coupled to said scroll groove of said first adjustment member for guiding said first adjustment member toward or away from said limiter member to carry said sliding block forward or backward along said sliding rail during rotation of said first adjustment member relative to said coupling shank by an external force.

2. The adjustable coupling device as claimed in claim 1, wherein said sliding block further comprises a limiter space defined in said block body and adapted for accommodating said limiter member.

3. The adjustable coupling device as claimed in claim 1, wherein said base member further comprises a plurality of locating grooves located at said base portion; said limiter member comprises a plurality of retaining portions clamped on said sliding rail of said base member and positioned in said locating grooves of said base member.

4. The adjustable coupling device as claimed in claim 1, further comprising a push member mounted in said accommodation chamber of said base member, said push member comprising a plurality of push plates disposed at one lateral side thereof and a bevel face located at a front side thereof.

5. The adjustable coupling device as claimed in claim 4, further comprising a second adjustment member pivotally coupled to said post, said second adjustment member comprising a thrust groove spirally extending around the periphery thereof and coupled with said push plates of said push member.

6. The adjustable coupling device as claimed in claim 4, wherein said base member comprises an elongated groove defined in a bottom side in said accommodation chamber; said push member further comprises a hook extended from a bottom side thereof and coupled to said elongated groove to guide sliding movement of said push member along said elongated groove.

7. The adjustable coupling device as claimed in claim 1, wherein said base member further comprises a serrated engagement portion located at one side of said base portion remote from said sliding rail, and a bearing portion located at said base portion at one side of said serrated engagement portion.

* * * * *